US012501991B2

(12) United States Patent
Shiver et al.

(10) Patent No.: US 12,501,991 B2
(45) Date of Patent: Dec. 23, 2025

(54) COMBINATION CHAIR AND PACK FRAME APPARATUS

(71) Applicants: Tim Shiver, Columbus, GA (US); Danny Breault, Columbus, TN (US)

(72) Inventors: Tim Shiver, Columbus, GA (US); Danny Breault, Columbus, TN (US)

( * ) Notice: Subject to any disclaimer, the term of this patent is extended or adjusted under 35 U.S.C. 154(b) by 69 days.

(21) Appl. No.: 18/666,555

(22) Filed: May 16, 2024

(65) Prior Publication Data

US 2025/0351947 A1 Nov. 20, 2025

(51) Int. Cl.

| | |
|---|---|
| ***A45F 4/02*** | (2006.01) |
| ***A45F 4/00*** | (2006.01) |
| ***A47C 4/28*** | (2006.01) |

(52) U.S. Cl.

CPC ..... *A45F 4/02* (2013.01); *A47C 4/28* (2013.01); *A45F 2004/006* (2013.01); *A45F 2004/026* (2013.01)

(58) Field of Classification Search

CPC ..... A45F 4/02; A47C 4/28

See application file for complete search history.

(56) References Cited

U.S. PATENT DOCUMENTS

| | | | | |
|---|---|---|---|---|
| 4,676,548 A | | 6/1987 | Bradbury | |
| 5,016,792 A | * | 5/1991 | Jay | A45F 4/02 224/155 |
| 5,303,975 A | | 4/1994 | Asato | |
| 5,499,760 A | * | 3/1996 | Pielocik | A47C 13/00 224/155 |
| 5,536,064 A | | 7/1996 | MacLean | |
| 5,538,318 A | * | 7/1996 | MacLean | A47C 4/52 224/155 |
| 5,628,437 A | * | 5/1997 | Kober | A01M 31/02 182/20 |
| 5,954,391 A | * | 9/1999 | Gray | A47C 4/18 297/58 |
| 6,145,716 A | * | 11/2000 | Caicedo | A45F 3/04 224/155 |
| 6,186,593 B1 | * | 2/2001 | Garneau | A47C 9/10 297/188.11 |
| 6,345,862 B1 | * | 2/2002 | Meinburg | A47C 4/52 297/118 |
| 6,547,324 B1 | * | 4/2003 | Ammann, Jr. | A45F 4/02 297/26 |
| 7,118,172 B1 | | 10/2006 | Pattison-Sheets | |

(Continued)

FOREIGN PATENT DOCUMENTS

| | | |
|---|---|---|
| WO | WO0041590 | 7/2000 |

*Primary Examiner* — Brian D Nash

(57) ABSTRACT

A combination chair and pack frame apparatus for alternately seating a user and supporting loads on the user's back includes a seat frame mounted on a main frame. The seat frame may be folded against the main frame, placed in a seat position, or placed in a pack position. A seat made of flexible material is attached to the main frame and a distal portion of the seat frame relative to the main frame. When the seat frame is in the seat position, the seat may be sat on. When the seat frame is in the pack position, a load may be supported on the seat. A harness mounts the main frame to the user's back when the seat frame is in the pack position. A support leg assembly selectively supports the main frame when the seat frame is in the seat position.

11 Claims, 9 Drawing Sheets

(56) References Cited

U.S. PATENT DOCUMENTS

| | | | | |
|---|---|---|---|---|
| 7,604,288 | B1 * | 10/2009 | Verhulst | A47C 13/00 297/129 |
| 9,332,852 | B1 * | 5/2016 | Milich | A45F 4/02 |
| 9,474,376 | B2 * | 10/2016 | Drew | A47C 3/18 |
| 10,028,587 | B1 * | 7/2018 | Kersey | A47C 4/52 |
| D850,135 | S | 6/2019 | Yang | |
| 10,321,780 | B1 | 6/2019 | Solomon | |
| 10,932,549 | B1 * | 3/2021 | DeMaio | A47C 7/622 |
| 2006/0261103 | A1 | 11/2006 | Strange | |
| 2007/0084891 | A1 * | 4/2007 | Gillespie | A47C 7/0213 224/155 |
| 2007/0262102 | A1 * | 11/2007 | Rininger | A45F 4/04 224/155 |
| 2008/0179358 | A1 | 7/2008 | Redzisz | |
| 2010/0133303 | A1 * | 6/2010 | Schilly | A45F 3/047 224/155 |
| 2015/0084381 | A1 * | 3/2015 | Nelson | A47C 4/00 224/155 |
| 2015/0366357 | A1 * | 12/2015 | Nelson | A47C 1/14 224/155 |
| 2020/0323331 | A1 * | 10/2020 | Marolia | A45F 3/04 |

* cited by examiner

COMBINATION CHAIR AND PACK FRAME APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to chairs and carrying apparatuses and more particularly pertains to a new combination chair and pack frame apparatus for alternately supporting a user in a seated position and supporting loads on the user's back.

(2) Description of Related Art Including Information Disclosed Under 37 CFR 1.97 and 1.98

The prior art discloses various foldable chairs, some of which include pouches or other carrying structures and harnesses so that the chair may be used in the same manner as a backpack. However, the prior art fails to disclose such a device in which a single frame is pivotally attached to a main frame and is movable through a space in the main frame to support either the user in a seated position or a load when the device is worn on the user's back. The prior art also fails to describe such a device with a deployable leg support for use with the device as a chair.

BRIEF SUMMARY OF THE INVENTION

An embodiment of the disclosure meets the needs presented above by generally comprising a seat frame mounted on a main frame. The seat frame is pivotable about a seat pivot at a proximal end thereof with respect to the main frame. The seat frame is movable among a seat position, a folded position, and a pack position. The seat frame is rotatable in a first rotatable direction from the folded position to the seat position and is rotatable in a second rotatable direction opposite the first rotatable direction from the folded position to the pack position. The folded position includes the seat frame being substantially aligned with the main frame and extends upwardly from the seat pivot with respect to the main frame. The seat position includes the seat frame extends forwardly from the main frame. The pack position includes the seat frame extends rearwardly from the main frame.

A seat comprises a flexible sheet which is coupled to and extends between the main frame and the seat frame. The seat is looped around a distal portion of the seat frame. The seat is configured to support a user on a front side of the seat when the seat frame is in the seat position and is configured to support a load on a rear side of the seat when the seat frame is in the pack position. A support leg assembly is mounted to the main frame and comprises a leg frame mounted to a back side of the main frame. The leg frame is positionable in a use configuration in which the leg frame extends downwardly from the main frame. A harness assembly is mounted to the main frame and is configured to attach the main frame to the user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
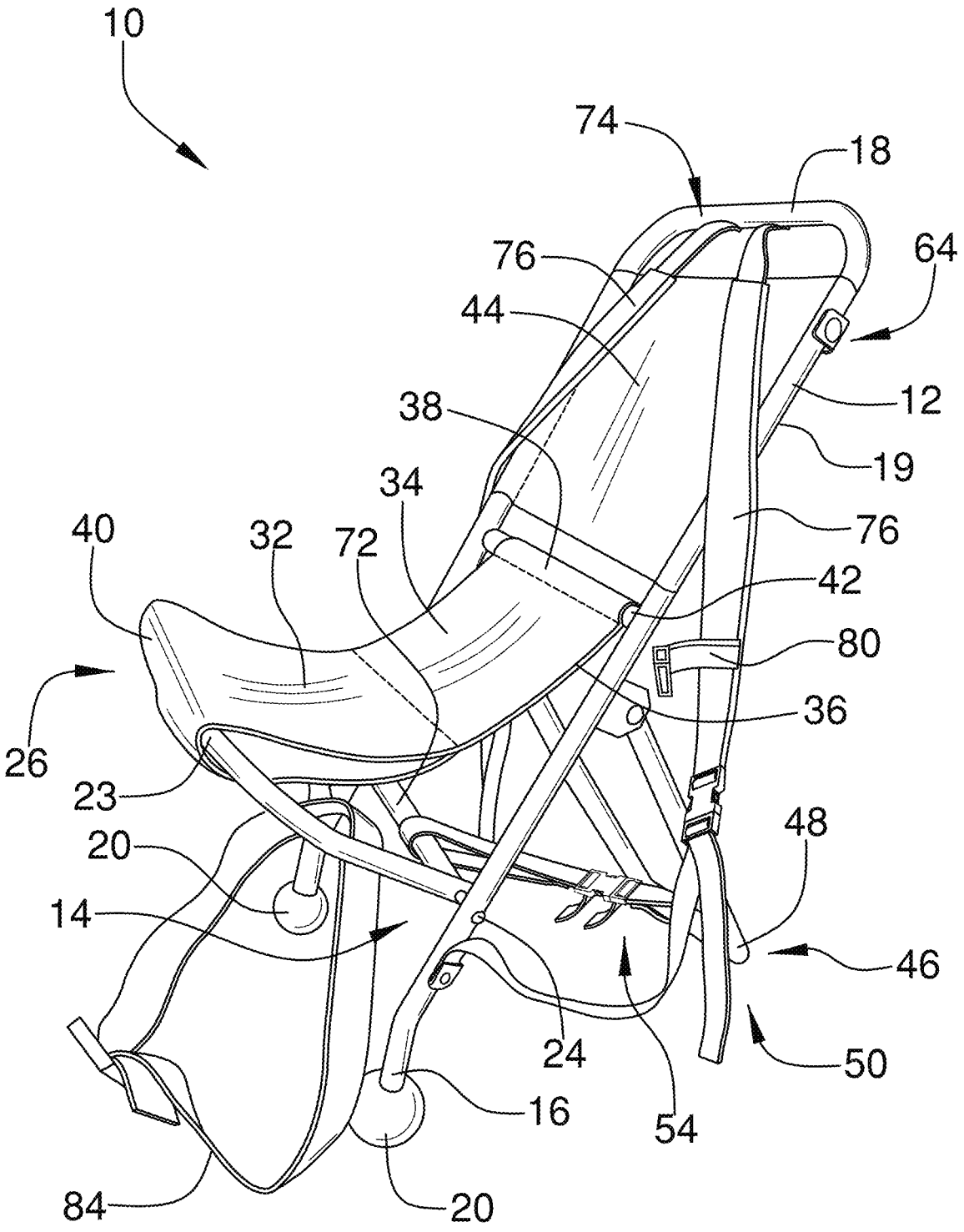
FIG. 1 is a perspective view of a combination chair and pack frame apparatus according to an embodiment of the disclosure. The apparatus is shown in a chair configuration.
Figure 2:
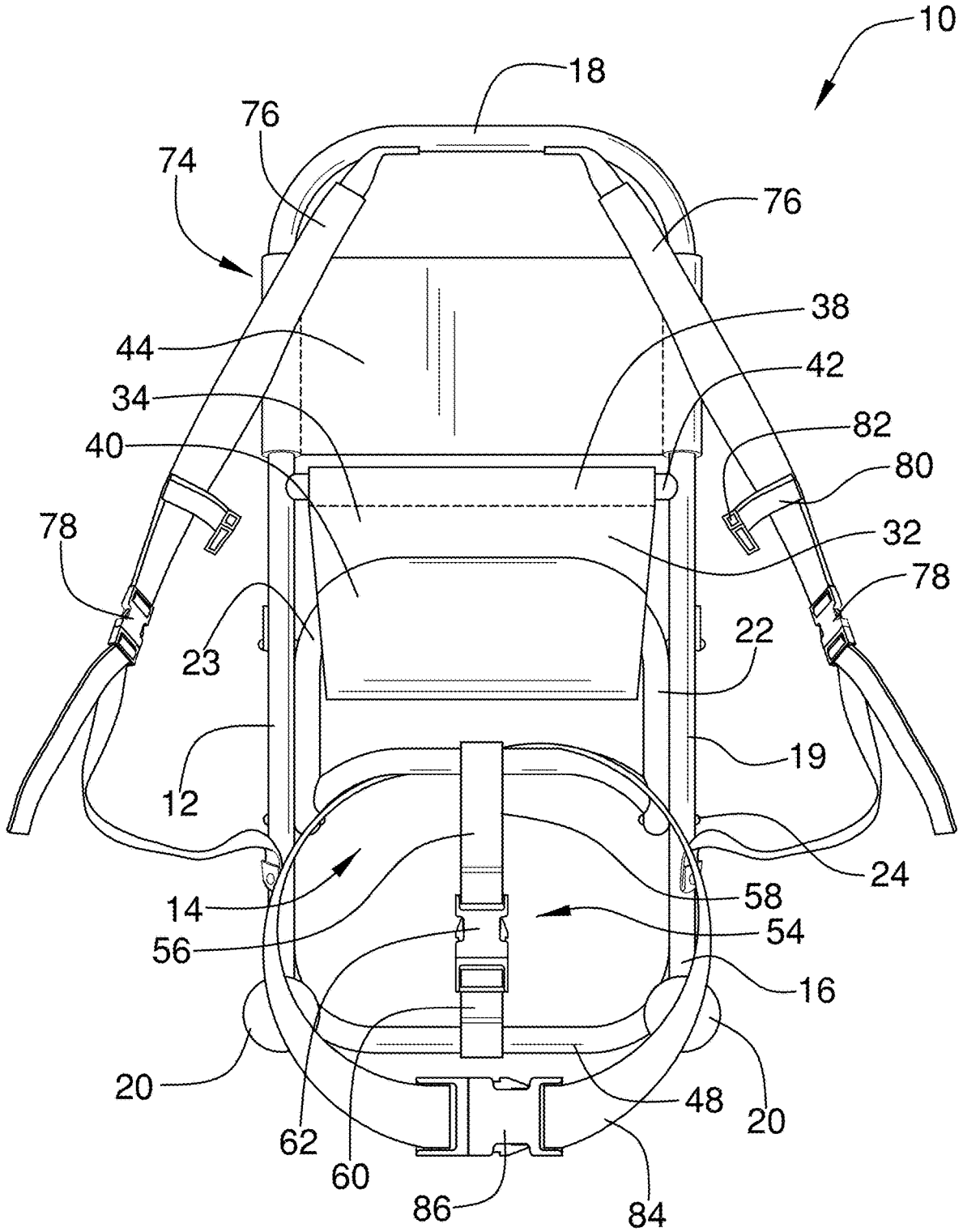
FIG. 2 is a front view of an embodiment of the disclosure in the chair configuration.
Figure 3:
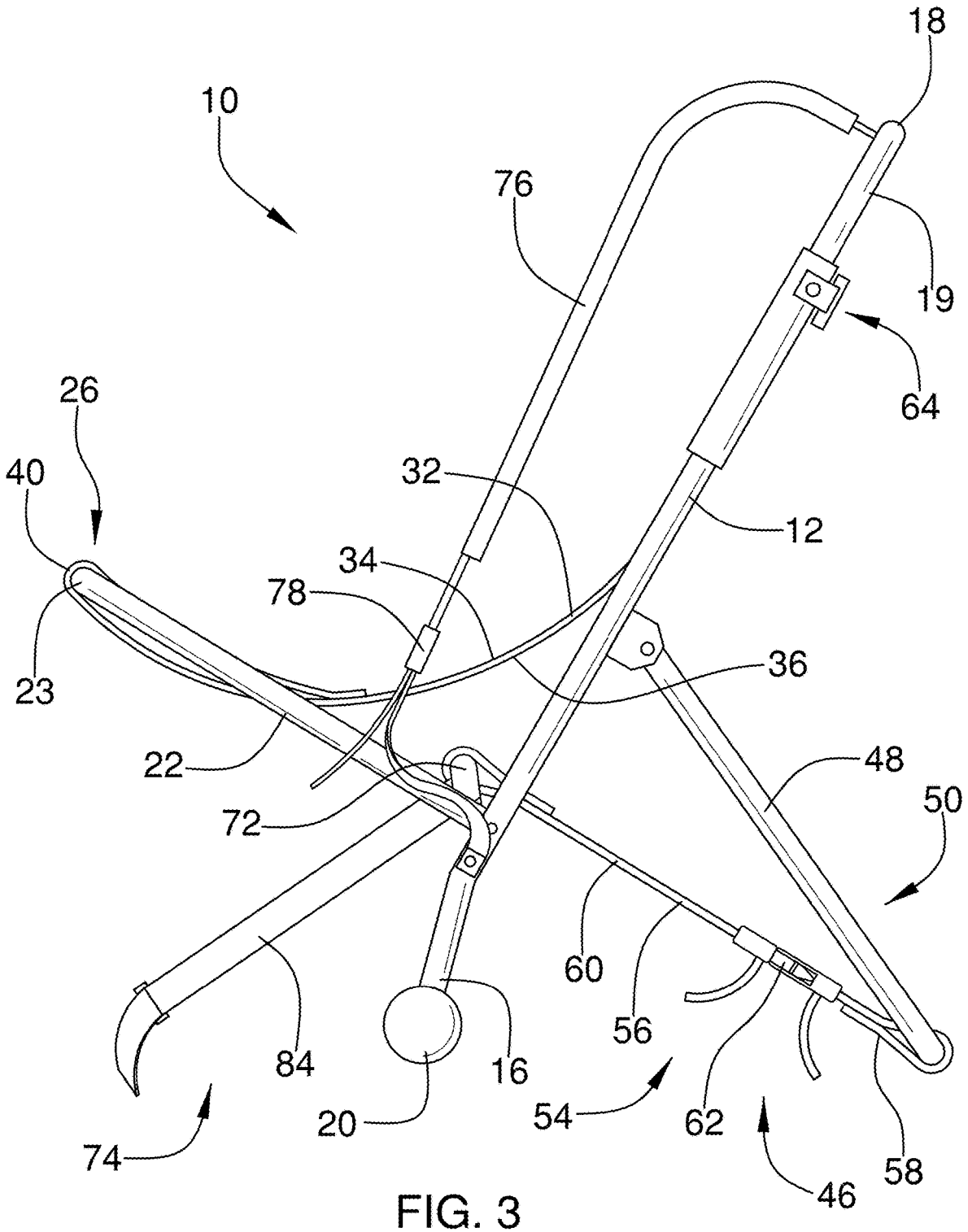
FIG. 3 is a side view of an embodiment of the disclosure in the chair configuration.
Figure 4:
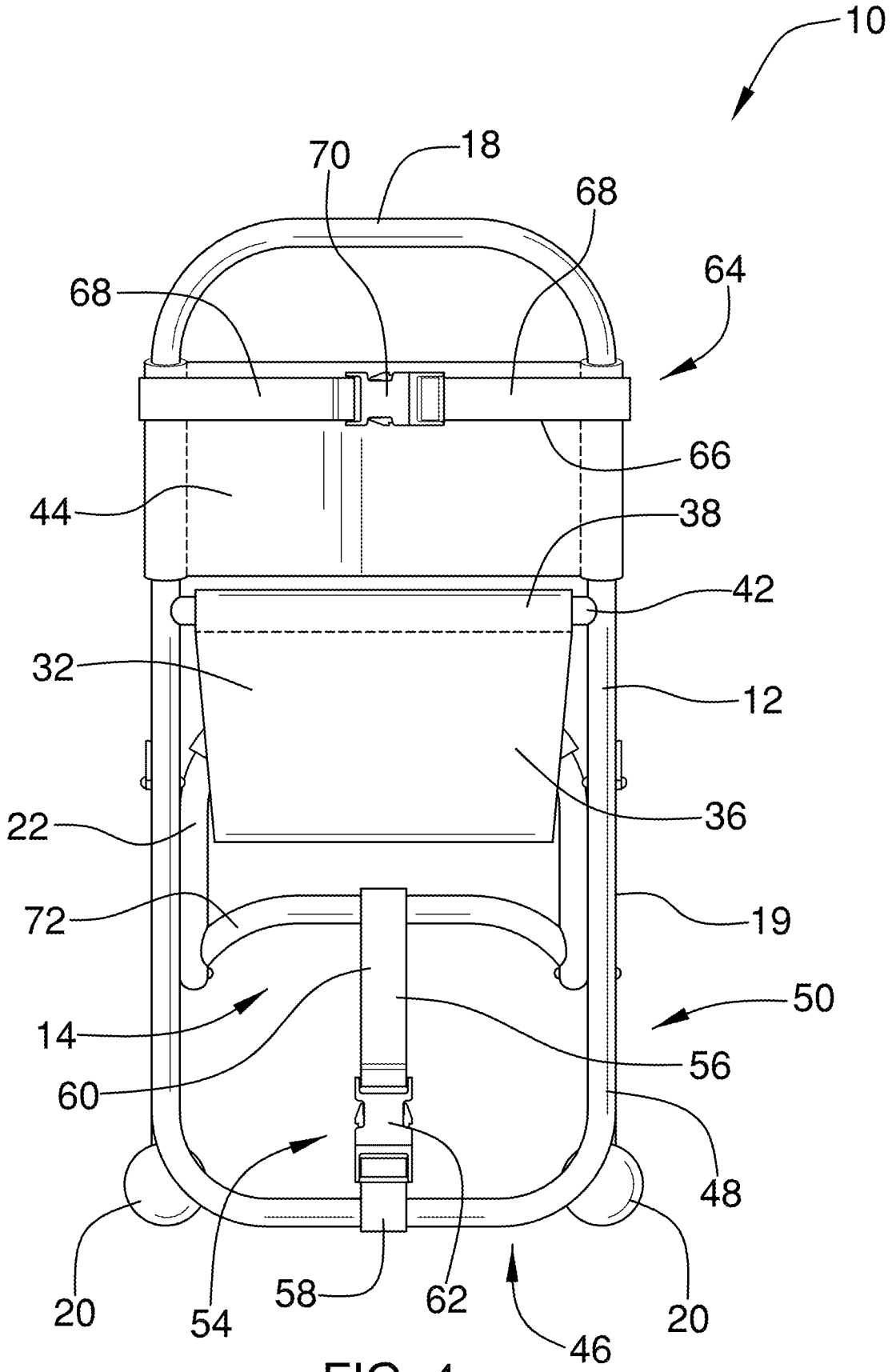
FIG. 4 is a rear view of an embodiment of the disclosure in the chair configuration.
Figure 5:
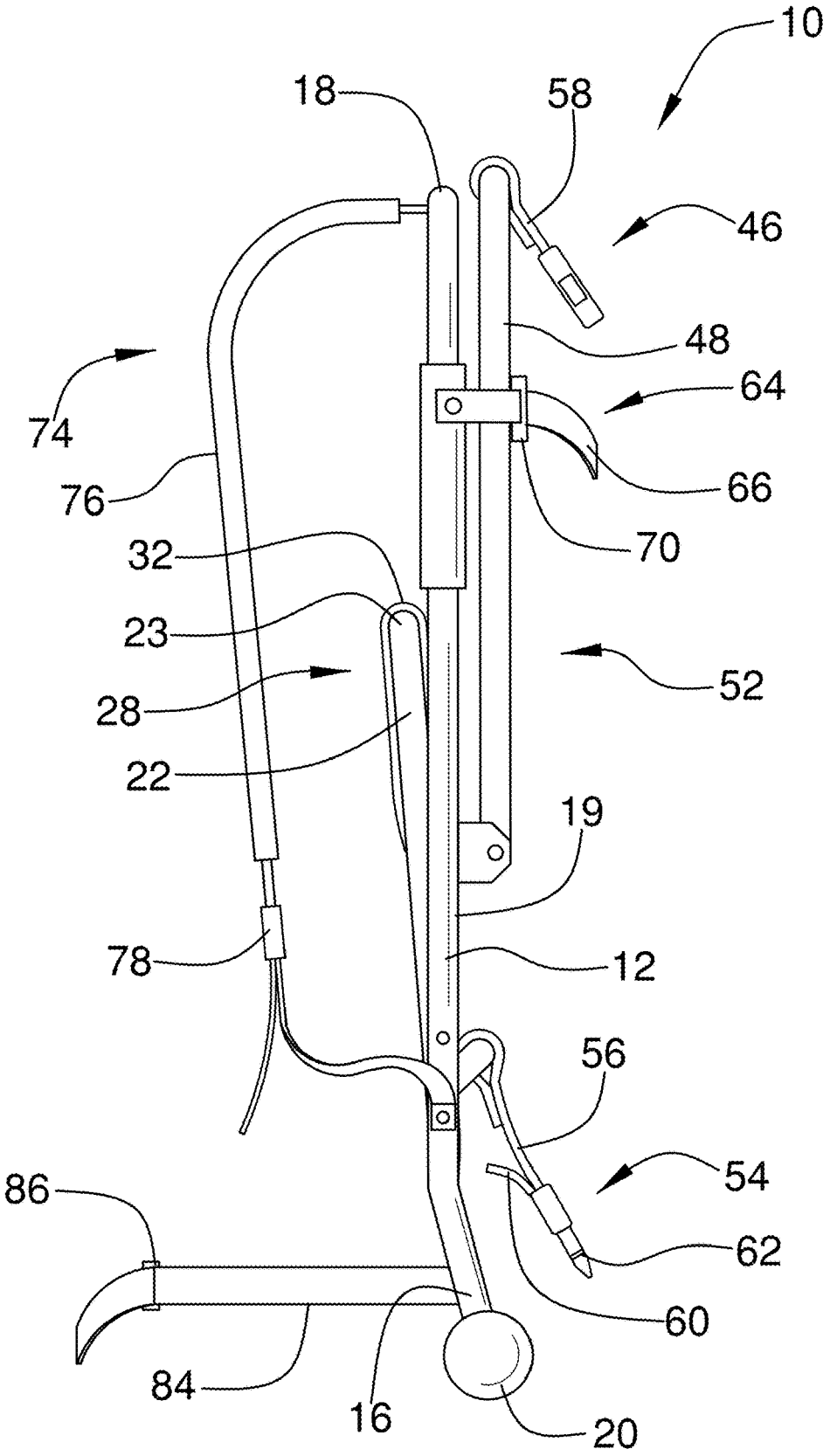
FIG. 5 is a side view of an embodiment of the disclosure. The apparatus is depicted in a folded configuration.
Figure 6:
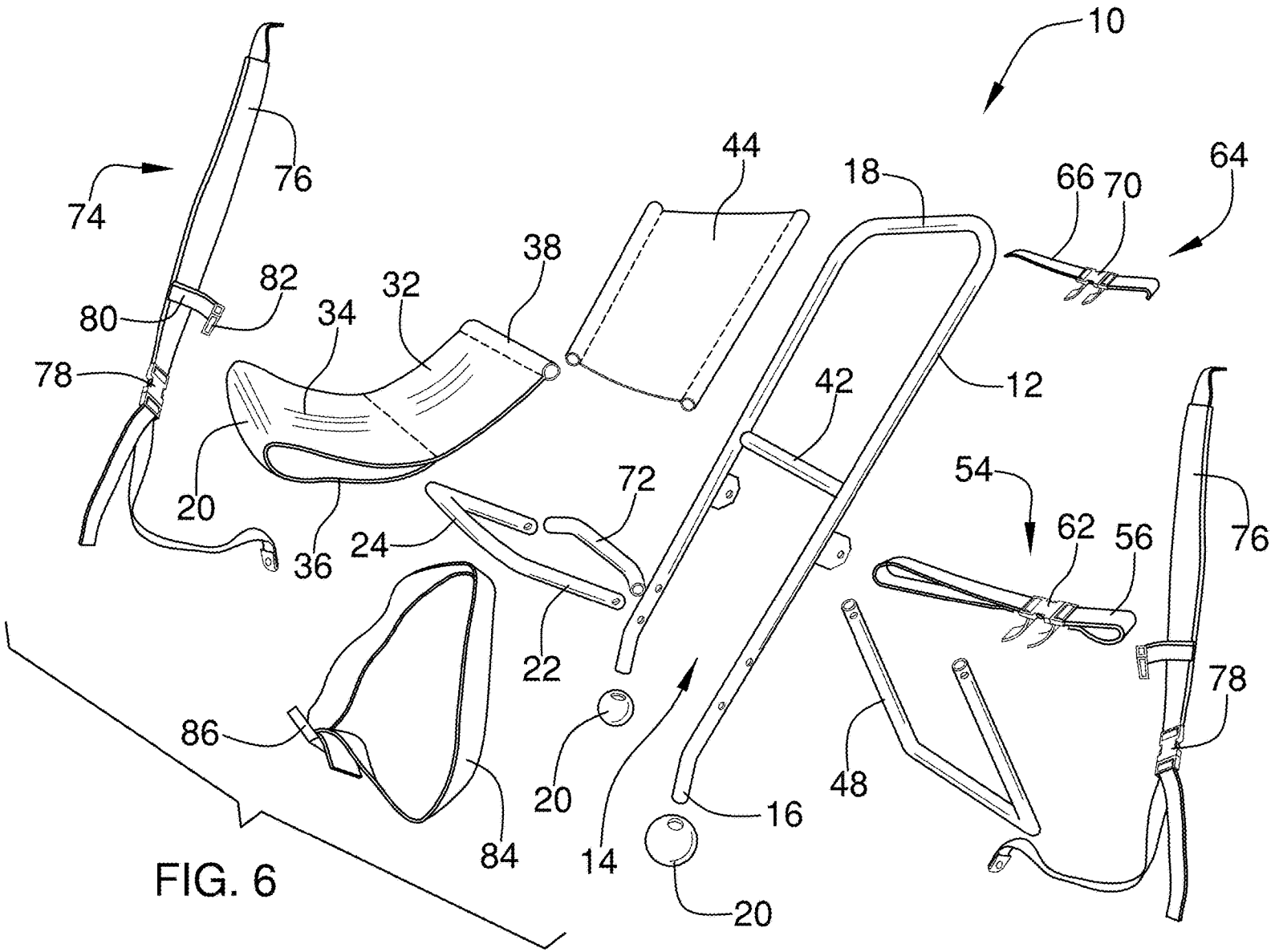
FIG. 6 is an exploded view of an embodiment of the disclosure.

With reference now to the drawings, and in particular to FIGS. 1 through 9 thereof, a new combination chair and pack frame apparatus embodying the principles and concepts of an embodiment of the disclosure and generally designated by the reference numeral 10 will be described.

As best illustrated in FIGS. 1 through 6, the combination chair and pack frame apparatus 10 generally comprises a main frame 12 constructed of a rod in a U-shape which defines a cavity 14 therein. The cavity 14 is open at a bottom end 16 of the main frame 12 and closed at a top end 18 of the main frame 12. Feet 20 are attached to ends of the rod which are wider than a width of the rod to distribute weight on a ground surface 88 when placed on the ground surface 88.

A seat frame 22 is coupled to the main frame 12 and positioned in the cavity 14. The seat frame 22 is pivotable about a seat pivot 24 at a proximal end thereof with respect to the main frame 12. The cavity 14 defined by the main frame 12 accommodates the seat frame 22 to pivot through the main frame 12 from one side to the other. In some embodiments, the main frame 12 may have other shapes provided an aperture is formed which allows for the seat frame 22 to move in this manner.

The seat frame 22 is movable among a seat position 26, a folded position 28, and a pack position 30. In the folded position 28, the seat frame 22 is substantially aligned with the main frame 12 and extends upwardly from the seat pivot 24 with respect to the main frame 12. The seat frame 22 may be pivoted forwardly with respect to the main frame 12 in a first rotational direction from the folded position 28 to the seat position 26. In the seat position 26, the seat frame 22 extends forwardly from the main frame 12. The seat frame 22 also may be pivoted rearwardly with respect to the main frame 12 in a second rotational direction from the folded position 28 to the pack position 30. In the pack position 30, the seat frame 22 extends rearwardly from the main frame 12.

A seat 32 constructed of a flexible sheet such as any suitable fabric material is coupled to and extends between the main frame 12 and the seat frame 22. A first end 38 of the seat 32 is attached to the main frame 12 via a seat crossbar 42, and a second end 40 is attached to a distal portion 23 of the seat frame 22. When the seat frame 22 is positioned in either the seat position 26 or the pack position 30, the seat 32 may be put into tension which prevents the seat frame 22 from rotating further downwardly with respect to the main frame 12. Items may be supported by the seat 32 when the seat frame 22 is in either the seat position 26 or the pack position 30. While placing items on the seat 32 may cause the seat 32 to buckle somewhat, part of the weight of the items will also be distributed to the seat frame 22. Thus, an equilibrium will be reached and the apparatus 10 will act to support the item. A back member 44 is also mounted to the main frame 12 above the seat 32. The back member 44 is also constructed of a flexible sheet such as any suitable fabric material. Materials for the seat 32 and the back member 44 may include, for example, canvas, nylon, polypropylene, or the like. In some embodiments, the back member 44 may be constructed of a rigid or semi-rigid material.

A support leg assembly 46 is mounted to the main frame 12 to help support the main frame 12 on the ground surface 88 when the apparatus 10 is being used as a chair. The support leg assembly 46 comprises a leg frame 48 which is pivotally mounted to a back side 19 of the main frame 12. The leg frame 48 may be moved between a use configuration 48 in which the leg frame 48 extends downwardly and rearwardly from the main frame 12 to prop the main frame 12 up on the ground surface 88 and a stored configuration 50 in which the leg frame 48 lies against the back side 19 of the main frame 12.

The support leg assembly 46 further comprises a use retainer 54 and a storage fastener 64. The use retainer 54 secures the leg frame 48 in the use configuration 48, and the storage fastener 64 secures the leg frame 48 in the stored configuration 50. The use retainer 54 comprises a leg strap 56 and a leg buckle 62. A first leg strap segment 58 of the leg strap 56 is coupled to the leg frame 48, and a second leg strap segment 60 of the leg strap 56 is coupled to the main frame 12 via a leg support crossbar 72. The first and second leg strap segments 58, 60 of the leg strap 56 are couplable to each other via the leg buckle 62. When the first and second leg strap segments 58, 60 are coupled, the leg strap 56 is placed in tension when the feet 20 and the leg frame 48 rest on the ground surface 88, thereby preventing the leg frame 48 from folding upwardly toward the stored configuration 50. The leg buckle 62 may be slidably coupled to one or both of the first and second leg strap segments 58, 60 such that a length of the leg strap 56 is adjustable.

The storage fastener 64 comprises a storage strap 66. The leg frame 48 is positionable between the storage strap 66 and the main frame 12 to secure the leg frame 48 in the stored configuration 50. The storage strap 66 comprises storage strap segments 68 selectively joined by a storage buckle 70. The storage buckle 70 may open to release the leg frame 48 from the stored configuration 50. In other embodiments, the storage fastener 64 may comprise a resilient band, a latch, a clamp, or any other suitable fastener.

A harness assembly 74 is mounted to the main frame 12 and is configured to attach the main frame 12 to the user's 90 back 98. The harness assembly 74 comprises a pair of shoulder straps 76, a chest strap 80, and a waist strap 84. The shoulder straps 76 are laterally spaced from each other with respect to the main frame 12 and are positioned to hang on the user's 90 shoulders 92. The chest strap 80 is coupled to and extends between the shoulder straps 76, and the waist strap 84 is coupled to and extends laterally across the main frame 12. During use, the chest strap 80 is placed across the user's 90 chest 94 and the waist strap 84 surrounds the user's 90 torso 96 below the chest strap 80. Each of the chest strap 80 and the waist strap 84 have buckles 82, 86 which allow the respective straps to open to release the main frame 12 from the user 90. The shoulder straps 76 also use buckles 76. The buckles 76, 82, 86 of the shoulder straps 76, chest strap 80, and waist strap 84 are slidable to adjust lengths of the respective straps. In other embodiments, the harness assembly 74 may comprise varied arrangements and quantities of straps to mount the apparatus 10 to the user's 90 back 98.

Figure 7:
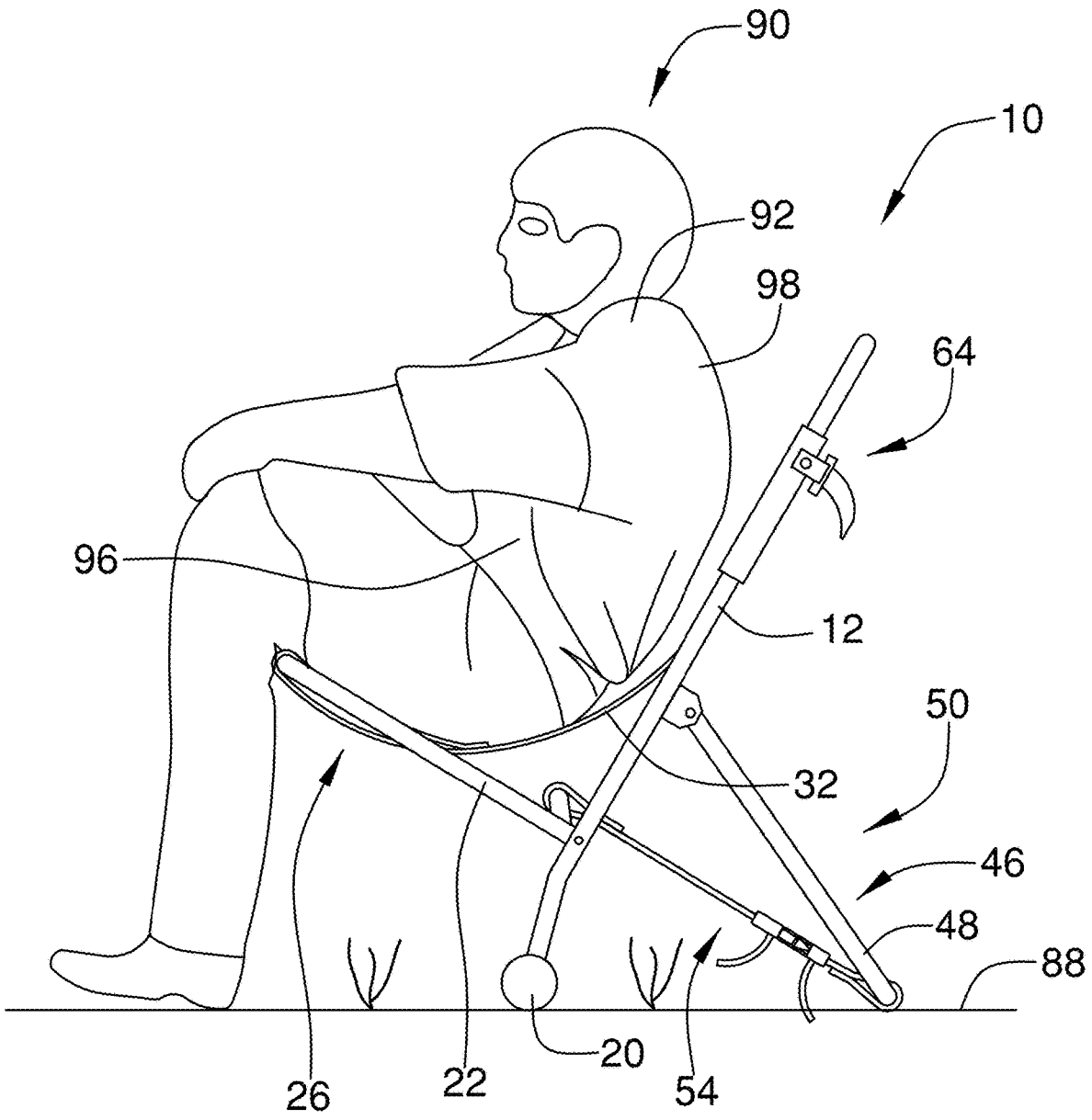
FIG. 7 is an in-use view of an embodiment of the disclosure in the chair configuration.

In use, the apparatus 10 may be used as a chair or a pack frame. With reference to FIG. 7, the user 90 may use the apparatus 10 as a chair by placing the seat frame 22 in the seat position 26 and the leg frame 48 in the use configuration 48. The apparatus 10 is placed so that the feet 20 and the leg frame 48 rest on the ground surface 88. Then the user 90 may sit on a front side 34 of the seat 32 to be supported above the ground surface 88. Adjusting the length of the leg strap 56 will adjust an angle of the leg frame 48 with respect to the main frame 12, and thereby adjusts an angle of the user 90 with respect to the ground surface 88.

Figure 8:
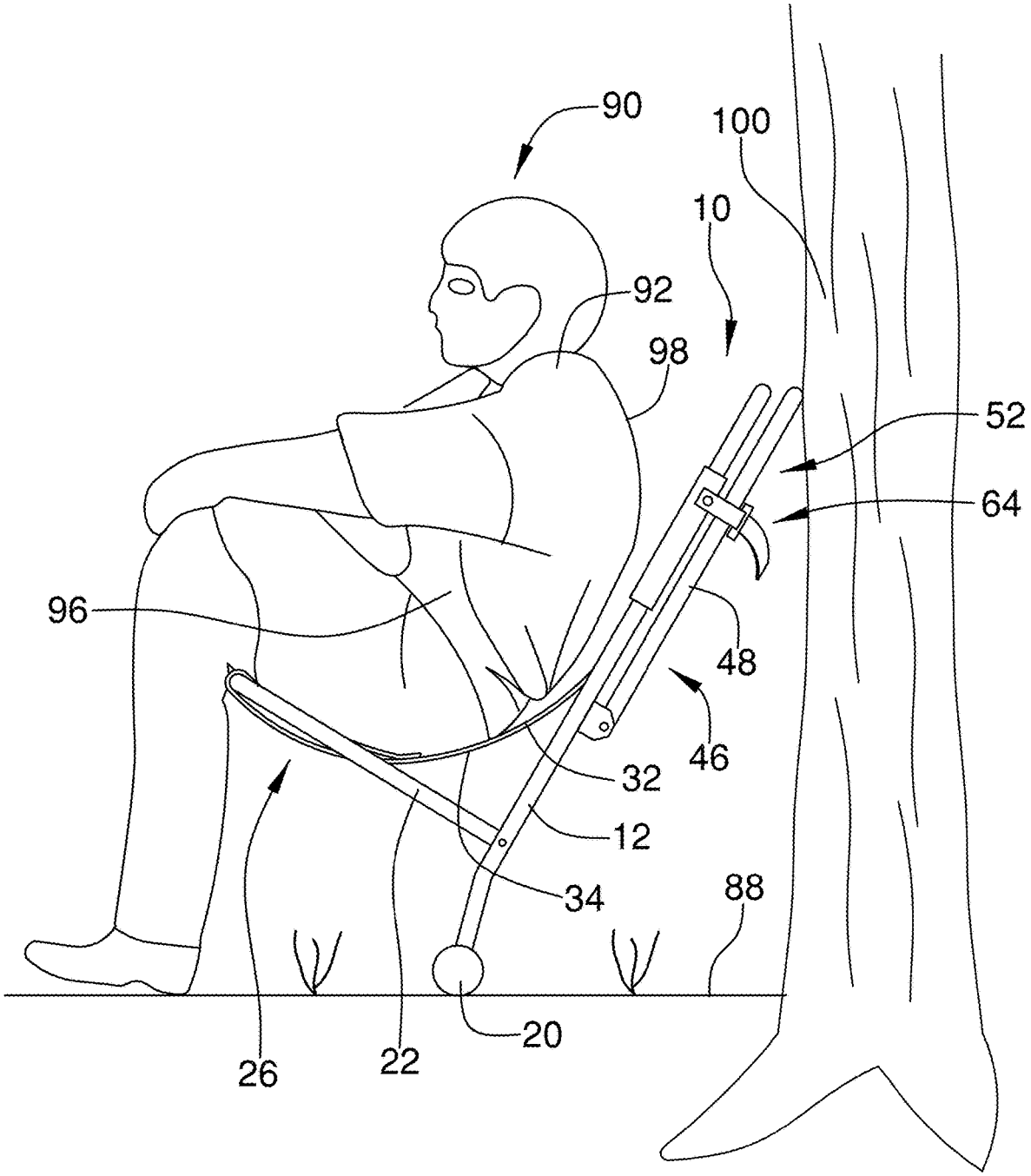
FIG. 8 is an in-use view of an embodiment of the disclosure in another chair configuration.

FIG. 8 depicts a use of the apparatus 10 as a chair in another manner. In this case, the leg frame 48 is secured in the stored configuration 50 by the storage fastener 64. The seat frame 22 remains in the seat position 26. In this arrangement, the main frame 12 or the leg frame 48 may be set against a vertical surface 100 such as the perimeter of a tree. The user 90 may adjust their seating position by placing the feet 20 closer or farther from the vertical surface 100, which adjusts the position of the main frame 12 or the leg frame 48 against the vertical surface 100.

Figure 9:
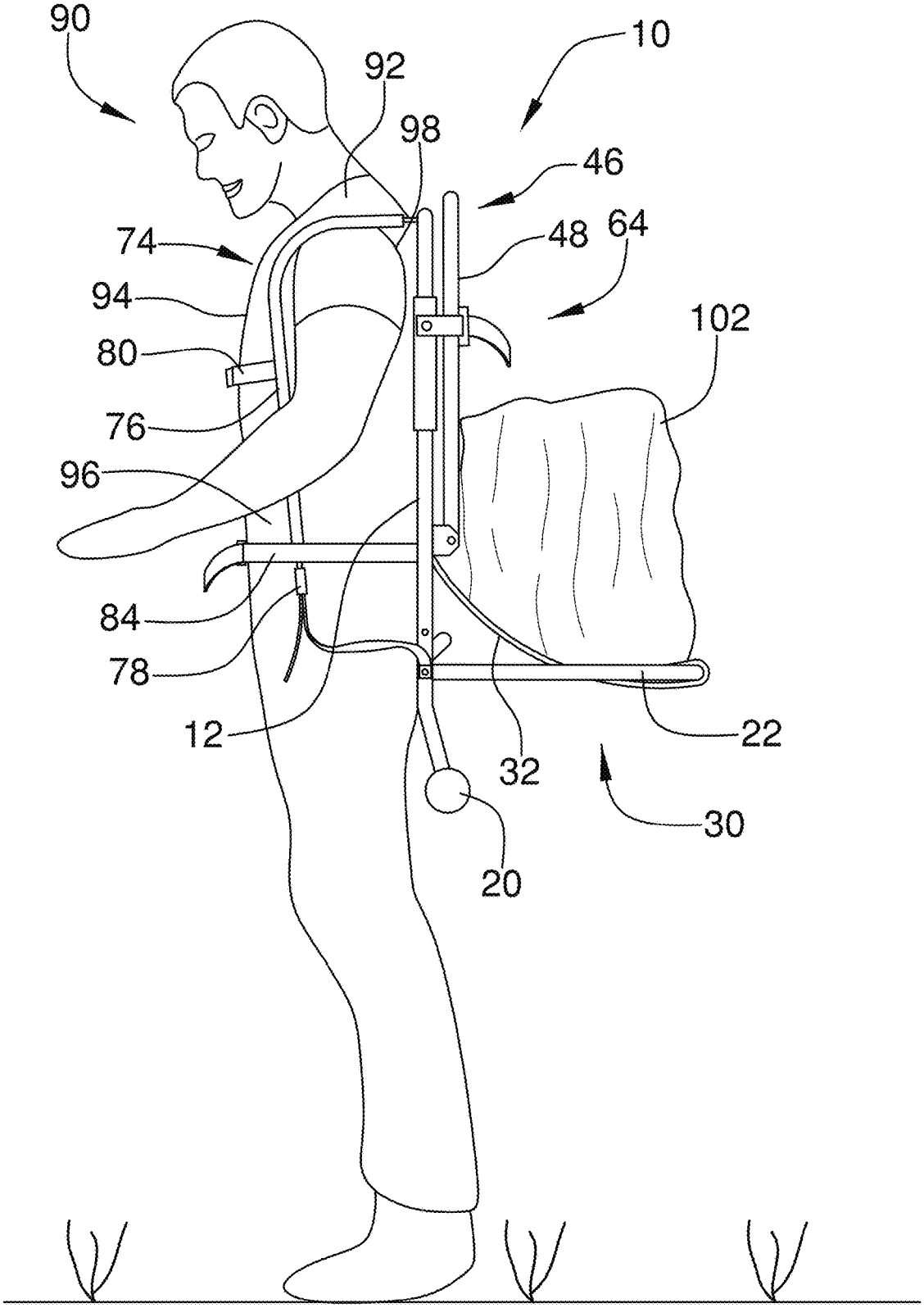
FIG. 9 is an in-use view of an embodiment of the disclosure in a pack configuration.

In FIG. 9, the apparatus 10 is shown as being used as a pack frame. The apparatus 10 is worn on the user's 90 back 98 via the harness 74, and the seat frame 22 is in the pack position 30. A load 102 is placed on a rear side 36 of the seat 32 akin to the user 90 sitting on the front side 34 of the seat 32 in the use of the apparatus 10 as a chair. The leg frame 48 is secured in the stored configuration 50 to make more room for the load 102.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A combination chair and pack frame apparatus comprising:

a main frame;

a seat frame coupled to the main frame, the seat frame being pivotable about a seat pivot at a proximal end thereof with respect to the main frame, the seat frame being movable among a seat position, a folded position, and a pack position, the seat frame being rotatable in a first rotatable direction from the folded position to the seat position and being rotatable in a second rotatable direction opposite the first rotatable direction from the folded position to the pack position, the folded position including the seat frame being substantially aligned with the main frame and extending upwardly from the seat pivot with respect to the main frame, the seat position including the seat frame extending forwardly from the main frame, the pack position including the seat frame extending rearwardly from the main frame;

a seat comprising a flexible sheet coupled to and extending between the main frame and the seat frame, the seat being looped around a distal portion of the seat frame, the seat being configured to support a user on a front side of the seat when the seat frame is in the seat position, the seat being configured to support a load on a rear side of the seat when the seat frame is in the pack position;

a support leg assembly mounted to the main frame, the support leg assembly comprising a leg frame mounted to a back side of the main frame, the leg frame being positionable in a use configuration in which the leg frame extends downwardly from the main frame; and a harness assembly mounted to the main frame and configured to attach the main frame to the user.

2. The apparatus of claim 1, wherein the main frame has a U-shape which defines a cavity therein, the cavity being open at a bottom end of the main frame and closed at a top end of the main frame, the seat frame being positioned in the cavity of the main frame.

3. The apparatus of claim 1, wherein the leg frame of the leg assembly is pivotally mounted to the main frame.

4. The apparatus of claim 3, wherein the leg assembly further comprises a use retainer configured to retain the leg frame in the use configuration.

5. The apparatus of claim 4, wherein the use retainer comprises a leg strap and a leg buckle, a first leg strap segment of the leg strap being coupled to the leg frame, a second leg strap segment of the leg strap being coupled to the main frame, the first and second leg strap segments of the leg strap being couplable to each other via the leg buckle.

6. The apparatus of claim 3, wherein the leg assembly further comprises a storage fastener configured to retain the leg frame in the stored configuration.

7. The apparatus of claim 6, wherein the storage fastener comprises a storage strap coupled to the main frame, the leg frame being positionable between the storage strap and the main frame to be secured in the storage configuration.

8. The apparatus of claim 1, wherein the harness assembly comprises a pair of shoulder straps mounted to the main frame, the shoulder straps being laterally spaced from each other with respect to the main frame and being configured to hang on shoulders of the user.

9. The apparatus of claim 8, wherein the harness assembly further comprises a chest strap coupled to and extending between the shoulder straps, the chest strap being configured to be positioned around a chest of the user.

10. The apparatus of claim 8, wherein the harness assembly further comprises a waist strap coupled to the main frame, the waist strap being configured to be positioned around a torso of the user.

11. A combination chair and pack frame apparatus comprising:

a main frame, the main frame having a U-shape which defines a cavity therein, the cavity being open at a bottom end of the main frame and closed at a top end of the main frame;

a seat frame coupled to the main frame and positioned in the cavity thereof, the seat frame being pivotable about a seat pivot at a proximal end thereof with respect to the main frame, the seat frame being movable among a seat position, a folded position, and a pack position, the seat frame being rotatable in a first rotatable direction from the folded position to the seat position and being rotatable in a second rotatable direction opposite the first rotatable direction from the folded position to the pack position, the folded position including the seat frame being substantially aligned with the main frame and extending upwardly from the seat pivot with respect to the main frame, the seat position including the seat frame extending forwardly from the main frame, the pack position including the seat frame extending rearwardly from the main frame;

a seat comprising a flexible sheet coupled to and extending between the main frame and the seat frame, the seat being looped around a distal portion of the seat frame, the seat being configured to support a user on a front side of the seat when the seat frame is in the seat position, the seat being configured to support a load on a rear side of the seat when the seat frame is in the pack position;

a support leg assembly mounted to the main frame, the support leg assembly comprising:

a leg frame pivotally mounted to a back side of the main frame, the leg frame being positionable in a use configuration in which the leg frame extends downwardly and rearwardly from the main frame, the leg frame being positionable in a stored configuration in which the leg frame extends from a leg pivot upwardly with respect to the main frame over the back side of the main frame;

a use retainer configured to retain the leg frame in the use configuration, the use retainer comprising a leg strap and a leg buckle, a first leg strap segment of the leg strap being coupled to the leg frame, a second leg strap segment of the leg strap being coupled to the main frame, the first and second leg strap segments of the leg strap being couplable to each other via the leg buckle; and a storage fastener configured to retain the leg frame in the stored configuration, the storage fastener comprising a storage strap coupled to the main frame, the leg frame being positionable between the storage strap and the main frame to be secured in the storage configuration; and a harness assembly mounted to the main frame and configured to attach the main frame to the user, the harness assembly comprising:

a pair of shoulder straps mounted to the main frame, the shoulder straps being laterally spaced from each other with respect to the main frame and being configured to hang on shoulders of the user;

a chest strap coupled to and extending between the shoulder straps, the chest strap being configured to be positioned around a chest of the user; and a waist strap coupled to the main frame, the waist strap being configured to be positioned around a torso of the user below the chest strap.

* * * * *